US005369854A

United States Patent [19]

Stephens

[11] Patent Number: 5,369,854

[45] Date of Patent: Dec. 6, 1994

[54] NECKLACE CLASP

[76] Inventor: Bonnie S. Stephens, 4317 Monticello Ave., Riverside, Calif. 92503

[21] Appl. No.: 84,950

[22] Filed: Jul. 1, 1993

[51] Int. Cl.[5] ..... A44B 13/00; A44C 1/00

[52] U.S. Cl. ..... 24/590; 24/116 A; 24/616; 24/598.1; 63/20

[58] Field of Search ..... 24/590, 616, 615, 598.1, 24/300, 301, 335, 647, 116 A, 68 J, 69 J, 70 J, 71 J; 63/4, 13, 20, 21

[56] References Cited

U.S. PATENT DOCUMENTS

| | | | |
|---|---|---|---|
| 195,164 | 9/1877 | Pope | 24/590 |
| 302,421 | 7/1884 | Mosier | 24/590 |
| 1,224,965 | 5/1917 | Schwartzman | 63/20 |
| 2,113,786 | 4/1938 | Garfinkel | 24/616 |
| 4,527,316 | 7/1985 | Murphy | 24/116 A |
| 4,689,861 | 9/1987 | Kopelowicz | 24/616 |
| 4,781,038 | 11/1988 | Branca et al. | 63/4 |
| 4,935,996 | 6/1990 | Ferrara | 24/598.1 |

FOREIGN PATENT DOCUMENTS

| | | | |
|---|---|---|---|
| 0237039 | 2/1911 | Germany | 24/116 A |

*Primary Examiner*—Victor N. Sakran

[57] ABSTRACT

A necklace clasp designed to permit the wearing of multiple necklaces or neck chains without them becoming entangled and having the overall appearance of a butterfly which comprises a two-part holding device with the edge of one part abutting the corresponding edge of the other part; each part having a central tubular core and planar wings extending from said central core; means in each of said wings to provide anchorage for the respective ends of a plurality of necklaces depending therefrom; and means to removeably engage the central tubular cores one from the other.

5 Claims, 5 Drawing Sheets

NECKLACE CLASP

BACKGROUND OF THE INVENTION

1. Field of the Invention

The present invention relates to necklace clasps and more particularly pertains to such a clasp which may be utilized to hold a plurality of necklaces depending therefrom about the neck of a wearer.

2. Description of the Prior Art

The use of necklace clasps is known in the prior art. More specifically, such clasps heretofore devised and utilized for the purpose of fastening necklaces, almost always one end to the other, are known to consist basically of familiar, expected and obvious structural configurations, notwithstanding the myriad of designs encompassed by the crowded prior art which have been developed for the fulfillment of countless objectives and requirements. Typical clasps are shown in U.S. Pat. Nos. 4,924,562; 4,879,882; 4,847,957; and Des. U.S. Pat. No. 312,982.

In this respect, the clasp according to the present invention substantially departs from the conventional concepts and designs of the prior art, and in so doing provides a device primarily developed for the purpose of placing multiple necklaces around a wearer's neck and eliminating entanglement thereof.

Therefore, it can be appreciated that there exists a continuing need for new and improved necklace clasp which can be simultaneously used for multiple necklaces. In this regard, the present invention substantially fulfills this need.

SUMMARY OF THE INVENTION

In view of the foregoing disadvantages inherent in the known types of necklace clasps now present in the prior art, the present invention provides an improved clasp construction wherein the same can be utilized with multiple necklaces simultaneously. As such, the general purpose of the present invention, which will be described subsequently in greater detail, is to provide a new and improved necklace clasp which has all the advantages of the prior art clasps and none of the disadvantages.

To attain this, the present invention essentially comprises a necklace clasp designed to permit the wearing of multiple necklaces or neck chains without them becoming entangled and having the overall appearance of a butterfly which comprises a two-part holding device with the edge of one part abutting the corresponding edge of the other part; each part having a central tubular core and planar wings extending from said central core; means in each of said wings to provide anchorage for the respective ends of a plurality of necklaces depending therefrom; and means to removeably engage the central tubular cores one from the other.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved necklace clasp which has all the advantages of the prior art clasps and none of the disadvantages.

It is another object of the present invention to provide a new and improved necklace clasp which may be easily and efficiently manufactured and marketed.

It is a further object of the present invention to provide a new and improved necklace clasp which is of a durable and reliable construction.

An even further object of the present invention is to provide a new and improved necklace clasp which is susceptible of a low cost of manufacture with regard to both materials and labor, and which accordingly is then susceptible of low prices of sale to the consuming public, thereby making such clasps economically available to the buying public.

Still yet another object of the present invention is to provide a new and improved necklace clasp which provides in the devices of the prior art some of the advantages thereof, while simultaneously overcoming some of the disadvantages normally associated therewith.

Still another object of the invention is to provide a necklace clasp for holding a plurality of depending necklaces which has an ornamental appearance itself, resembling a butterfly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
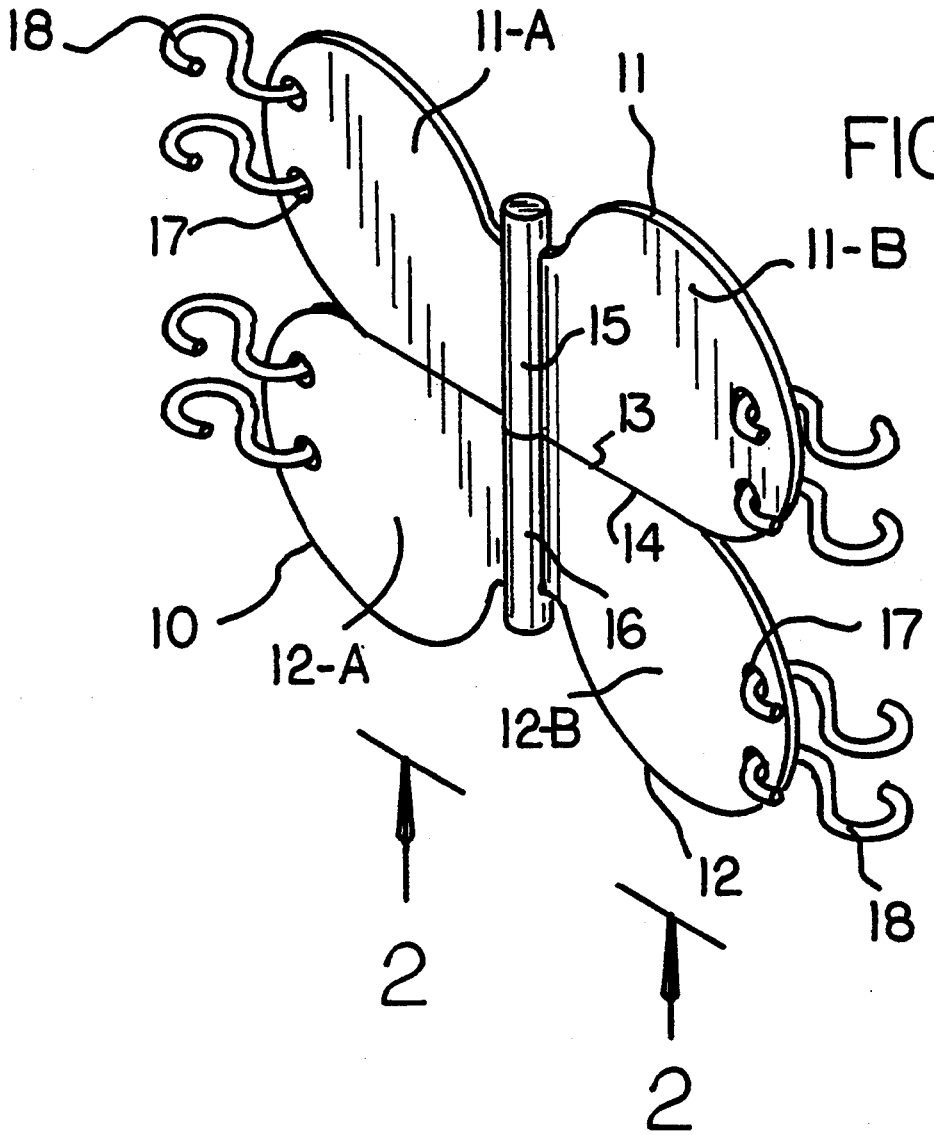
FIG. 1 is a perspective view of the basic device of the present invention.

With reference now to the drawings, and in particular to FIG. 1 thereof, a new and improved necklace clasp embodying the principles and concepts of the present invention and generally designated by the reference numeral 10 will be described.

More specifically, it will be noted that the clasp 10 is formed of two parts 11 and 12 one vertically above the other with a flat edge 13 on part 11 abutting a corresponding flat edge 14 on part 12. Each part 11 and 12 is composed of a tubular central core 15 and 16 respectively which also abut one another for the purpose disclosed and discussed below in the discussion of FIGS. 3 and 4. Each part 11 and 12 also has a pair of laterally extending planar members, designated by 11-A and 11-B and 12-A and 12-B affixed to the central core members 15 and 16. Each of such extending planar members, e.g. 11-A has in the outer periphery thereof a pair of holes 17 with an associated "S" hook 18 engaged therein. Such "S" hooks 18 may all extend from the surfaces of the planar members in the same direction or some may extend in opposed relationship as shown in FIG. 1, e.g. with respect to 11-A and 11-B. The function of the "S" hooks 18 are to engage and retain the ends of necklaces or neck chains (not shown) dependant therefrom.

Figure 2:
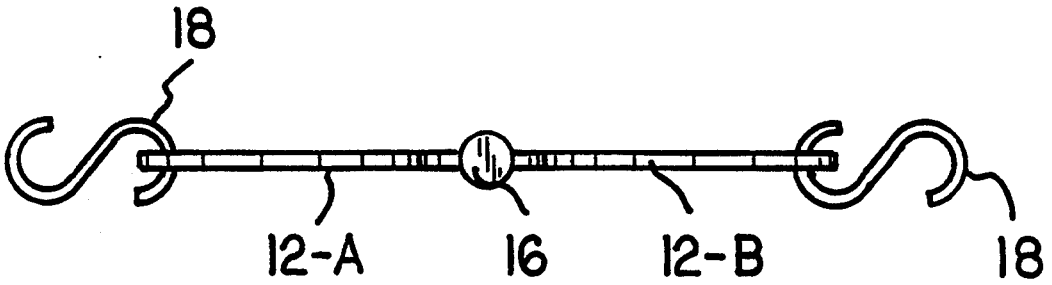
FIG. 2 is a bottom view on line 2—2 of FIG. 1.

FIG. 2 is a bottom end view on line 2—2 of FIG. 1, again showing the central core 16, extending planar members 12-A and 12-B and "S" hooks 18 extending therethrough.

Figure 3:
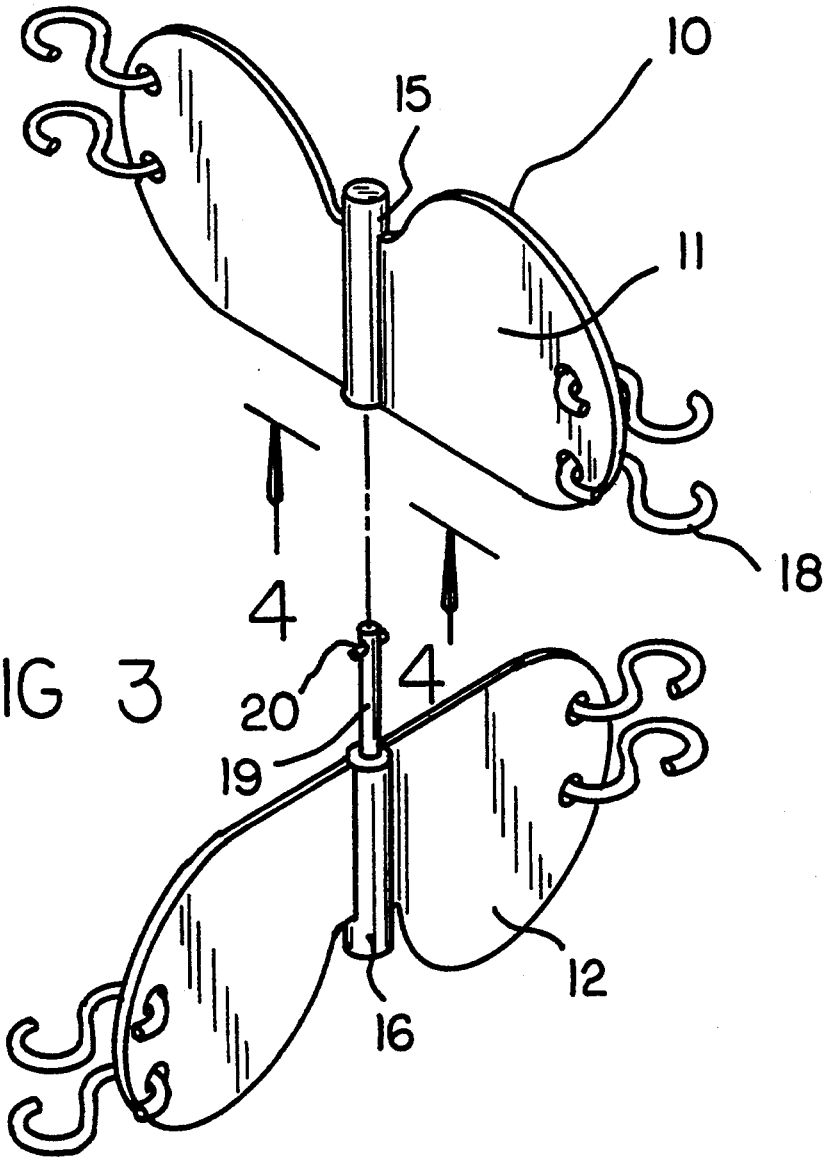
FIG. 3 is an exploded perspective view of the device shown in FIGS. 1 and 2.
Figure 4:
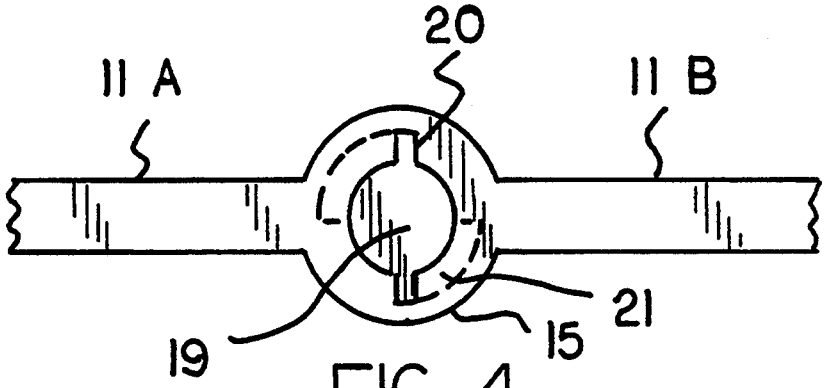
FIG. 4 is a bottom view of the upper part of the clasp shown in FIG. 3, taken on line 4—4 of FIG. 3.

FIG. 3 illustrates in an exploded view the manner in which parts 11 and 12 are engaged together and also separated one from the other. Core member 16 has an internal stem 19 having a protrubance 20 thereon adapted to engage within and mate with a corresponding groove 21 in core member 15 when partially rotated. This allows removal of upper part 11 with its associated necklaces depending from its "S" hooks 18, facilitating removal of clasp 10 from the neck of the wearer. To complete removal, one end of each necklace depending from the "S" hooks of bottom part 12 is taken off the "S" hook allowing the device 10 to be completely removed.

Figure 5:
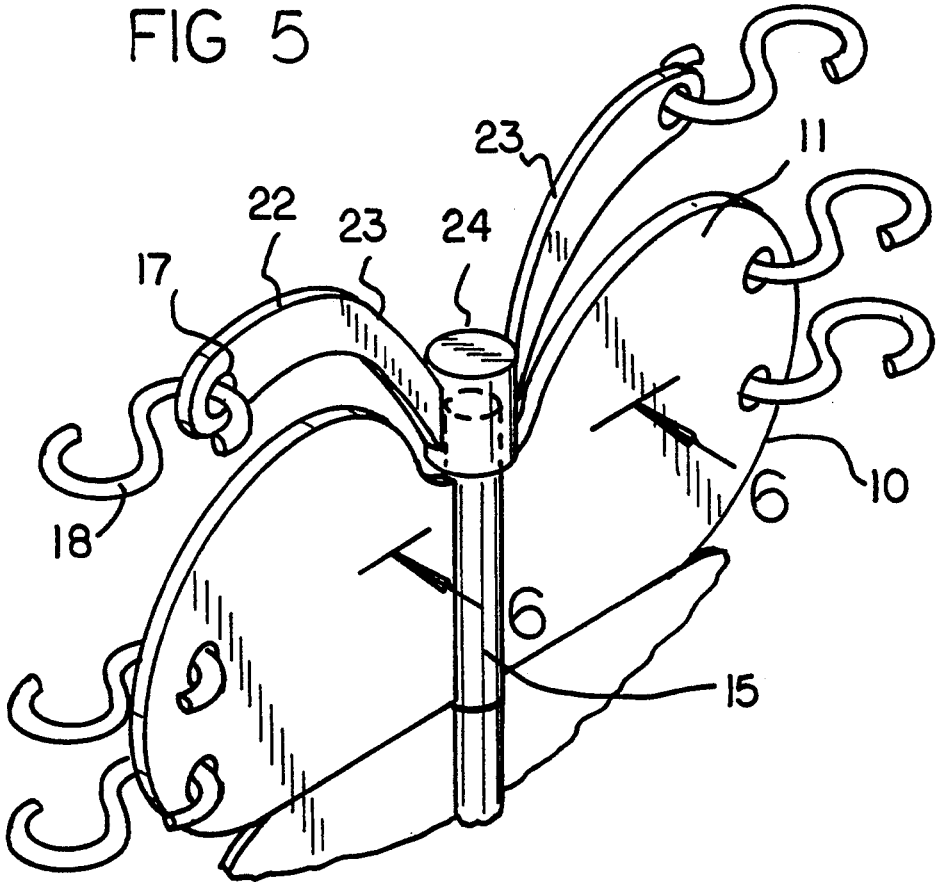
FIG. 5 is a perspective view of the upper part of the clasp shown in FIG. 3, with a modification applied thereto.
Figure 6:
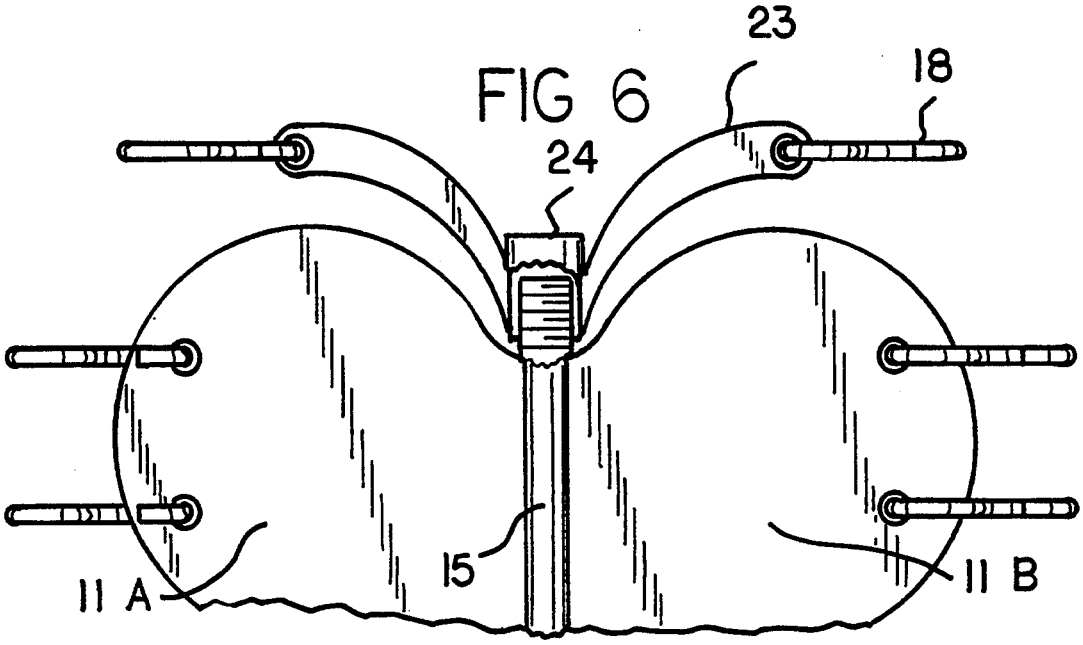
FIG. 6 is a partial sectional view on line 6—6 of FIG. 5.

FIGS. 5 and 6 illustrate a modification to the upper part 11 of clasp 10 wherein an additional holder 22 comprising another pair of laterally extending members 23 affixed to a hollow cap 24 of such diameter as to permit frictional engagement with the top of control core 15. Since members 23, like those of 11-A and 11-B have holes 17 and associated "S" hooks 18 in the outer periphery thereof, this modification will permit the addition of two more depending necklaces to those carried by the basic device 10.

Figure 7:
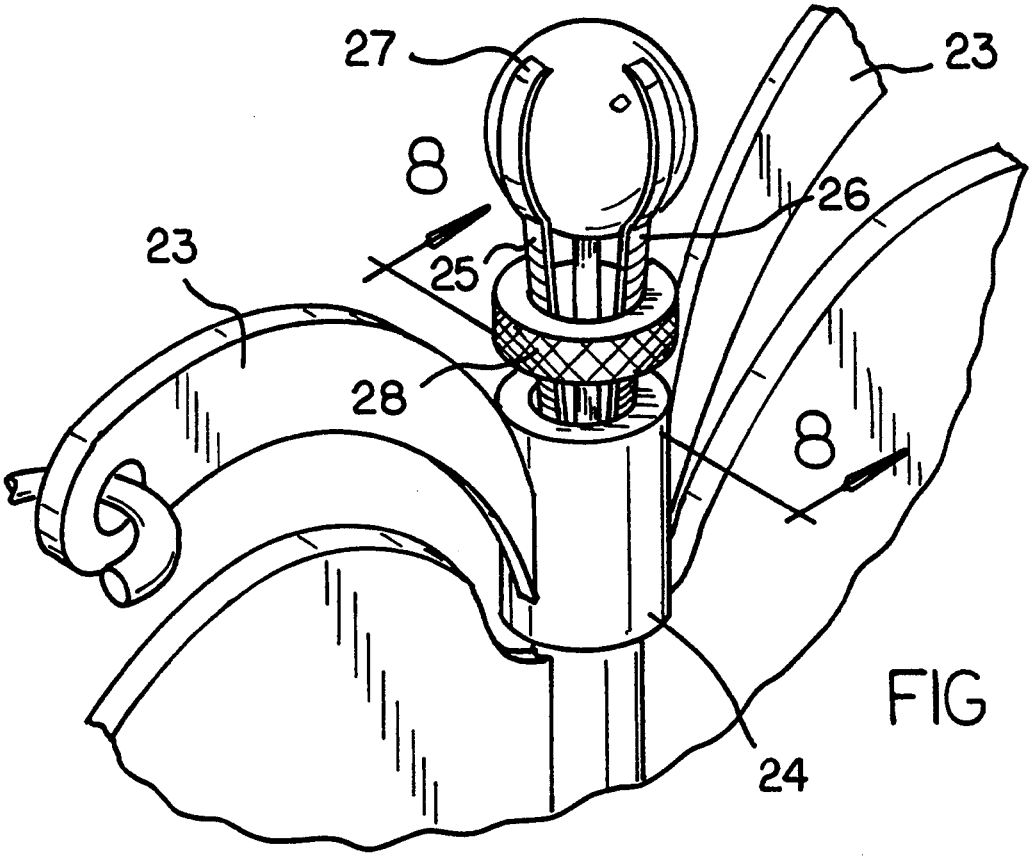
FIG. 7 is a perspective view of a further modification of the upper part of the clasp shown in FIG. 3.
Figure 8:
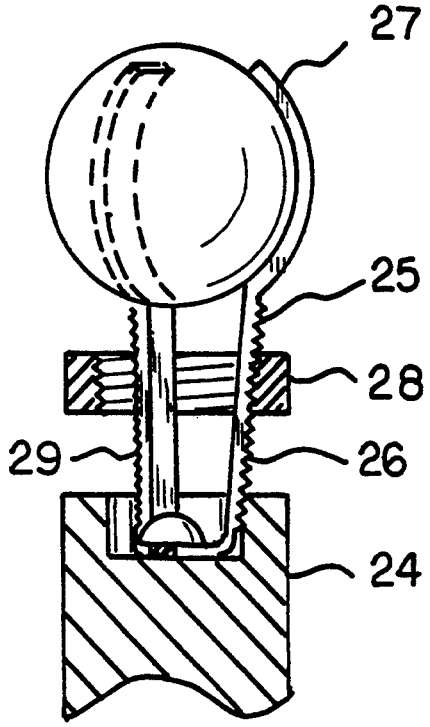
FIG. 8 is a sectional view on line 8—8 of FIG. 7.

FIGS. 7 and 8 illustrate a modification of the device shown in FIGS. 5 and 6 wherein the cap 24 is provided with an extension 25 having three resilient arms 26 rising therefrom. Each such arm 26 terminates in a carved clamping end 27 and can be caused to bring such ends 27 into closer proximity one with the other by rotation of a collar 28 extending around such arms 26 and riding in threads 29 formed in each of arms 26. This permits the addition of a decorative element 30 (which may be a pearl, an ornamental globe, or other ornament) to the top of extension 25 with the clamping ends 27 engaging therewith through compression of arms 26 by rotation of collar 28.

Figure 9:
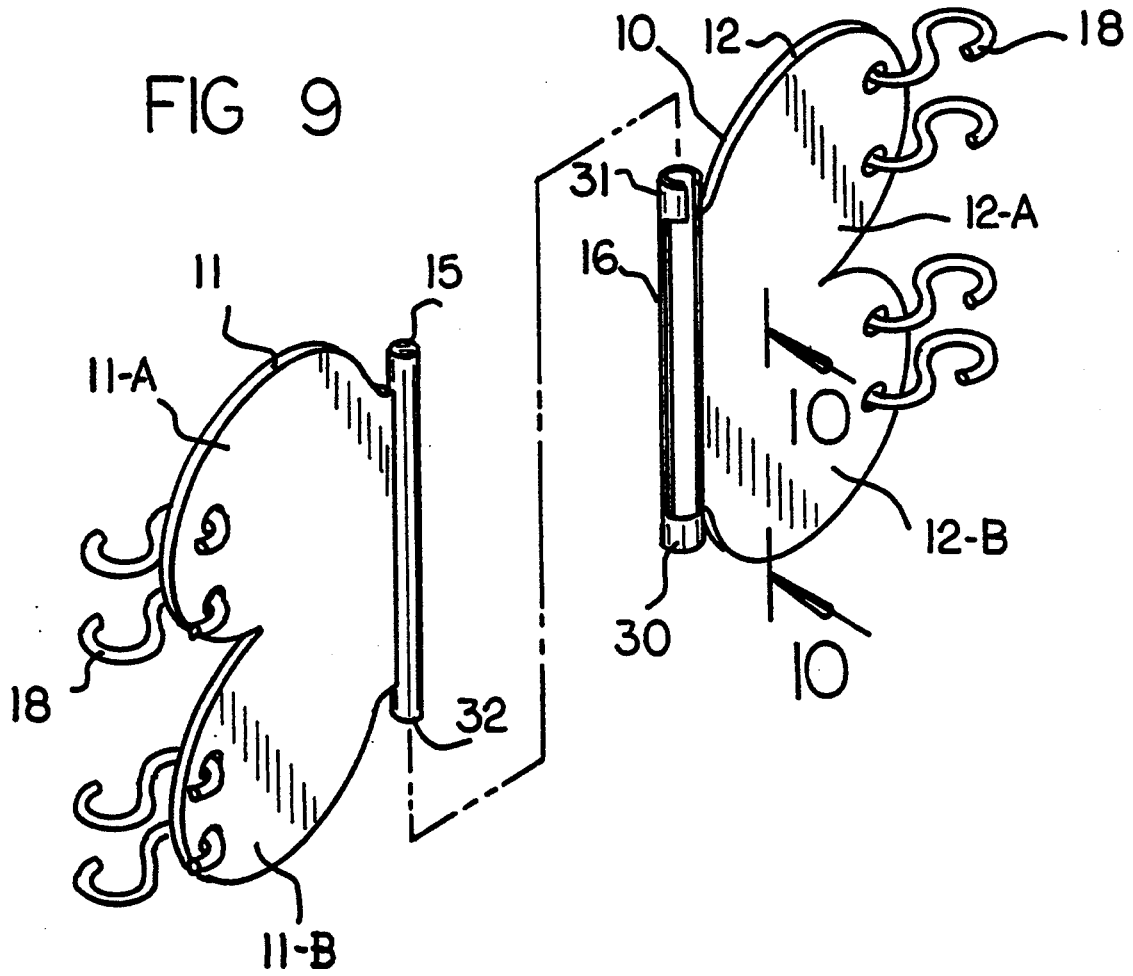
FIG. 9 is a perspective view of a preferred form of the basic device of the present invention.
Figure 10:
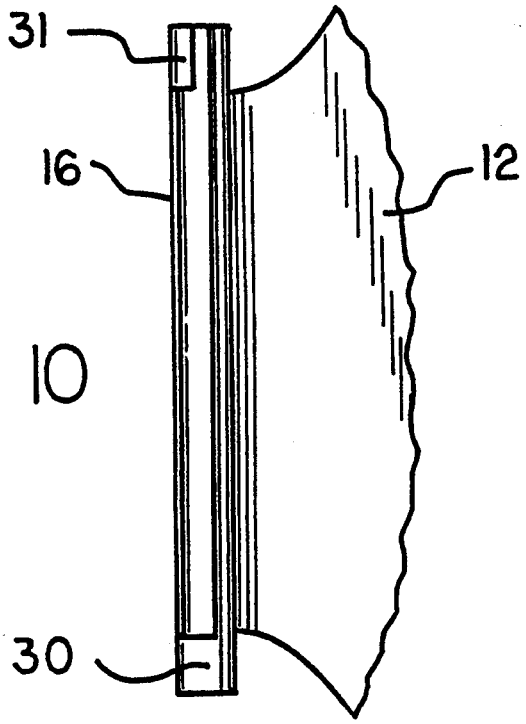
FIG. 10 is an enlarged plan view of one portion of such device taken on line 10—10 of FIG. 9.

In FIGS. 9 and 10 another version of the clasp device 10 is shown (actually a preferred version in terms of manufacture and use) wherein the separation between the halves 11 and 12 is achieved along the abuttment between the tubular central cores 15 and 16. In this version the laterally extending members 11 and 12 have the pairs of lobes or wings 11-A and B and 12-A and B formed as unitary members connected to the tubular central cores 15 and 16 respectively. One of the tubular central cores (16) comprises a hollow shell having the base 30 thereof closed and the top thereof having a tab 31 extending partially around the periphery of tubular core 16. Tubular core 16 is sufficiently larger in diameter than core 15 to permit core 15 to fit therein. To assemble, half 12 of clasp 10 is rotated to permit core 16 to slide up and encompass the tubular core 15 so that the base 32 of core 15 will engage in abutting relationship with the closed end 30 of core 16. Rotating half 12 back into parallel relationship with half 11 of clasp 10 allows the tab 31 to engage with and rest upon the top of wing or lobe 11-A thus preventing separation of the clasp 10 halves 11 and 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Generally the clasp is quite small, on the order of an inch or so square, and preferably is formed of plated brass, precious metals or the like. In overall appearance the clasp resembles a butterfly having its wings spread and with the central tubular core resembling the body of such butterfly.

Therefore, the foregoing is considered has illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A necklace clasp which comprises a two part holding device with the edge of one part abutting the corresponding edge of the other part; a central tubular core member positioned in each part; a pair of planar wings extending from said central tubular core; means in each of said wings to provide anchorage for one end of a plurality of necklaces depending therefrom; and means to removably engage and disengage said central tubular cores one from the other;

wherein a further pair of wings is provided at the top thereof; a hollow cap member affixed to said further pair of wings and adapted to frictionally engage with the top of said central tubular core; and means on said further pair of wings to affix an additional depending necklace thereto.

2. A necklace clasp as in claim 1, wherein said hollow cap is provided with means to affix an ornamental object to the top thereof.

3. A necklace clasp comprising:

a first central core member having first and second ends with an stem projecting from said first end thereof and arranged colinearly relative to a longitudinal axis of said first central core, said stem having at least one protrubance extending substantially orthogonally therefrom;

a first pair of extending planar members projecting from said first central core member, said first pair of planar members each having at least one hole extending therethrough with an S-shaped hook extending through an individual one of said at least one hole in each of said first pair of planar members;

a second central core member having first and second ends and having a hollow interior extending from said first end thereinto, with at least one groove circumferentially extending at least partially around an interior surface of said hollow interior such that said stem is received within said hollow interior of said second central core member, whereby a rotation of said first central core member relative to said second central core member engages said protrubance to said groove to removably secure said first central core to said second central core in a colinear arrangement relative to both said longitudinal axis of said first central core member and a longitudinal axis of said second central core member, wherein said first ends of said central core members are positioned in an abutting relationship;

and, a second pair of extending planar members projecting from said second central core member, said second pair of planar members each having at least one hole extending therethrough with an S-shaped hook extending through an individual one of said at least one hole in each of said second pair of planar members.

4. The necklace clasp as in claim 5, wherein said at least one hole in each of said pair of planar members comprises a plurality of holes.

5. The necklace clasp as in claim 4, wherein the overall appearance thereof is that of a butterfly with wings spread.

* * * * *